US005575092A

United States Patent [19]

Smit

[11] Patent Number: 5,575,092

[45] Date of Patent: Nov. 19, 1996

[54] DRAGLINE BUCKET

[75] Inventor: Andries J. Smit, Hendrina, South Africa

[73] Assignee: Van Reenen Steel (Proprietary) Limited, Gauteng, South Africa

[21] Appl. No.: 492,569

[22] Filed: Jun. 20, 1995

[30] Foreign Application Priority Data

Jun. 21, 1994 [ZA] South Africa ..... 94/4425

[51] Int. Cl.[6] ..... E02F 3/46

[52] U.S. Cl. ..... 37/398; 37/397; 37/399

[58] Field of Search ..... 37/395, 396, 397, 37/398, 399, 195, 444, 455, 457; 172/719, 751; 403/374

[56] References Cited

U.S. PATENT DOCUMENTS

| | | | |
|---|---|---|---|
| 1,852,671 | 4/1932 | Page | 37/398 |
| 1,979,738 | 11/1934 | Gibson | 37/398 |
| 2,492,905 | 12/1949 | Van Buskirk | 37/398 |
| 2,689,418 | 9/1954 | Van Buskirk | 37/398 |
| 2,895,239 | 7/1959 | Larsen | 37/398 |
| 3,181,257 | 5/1965 | Larsen | 37/398 |
| 3,597,865 | 8/1971 | Rumfelt | 37/396 |
| 4,902,473 | 2/1990 | Arata et al. | 420/105 |
| 5,343,641 | 9/1994 | Gregory | 37/396 X |

*Primary Examiner*—Terry Lee Melius
*Assistant Examiner*—Robert Pezzuto
*Attorney, Agent, or Firm*—Oblon, Spivak, McClelland, Maier & Neustadt, P.C.

[57] ABSTRACT

The dragline bucket has a basket (12) with an open from end and an open top defined by bottom, side and rear walls (14, 16, 18). Cheek plate structures (44) of fabricated steel plate construction are carried by the side walls at the front end of the basket and themselves carry drag attachment points (46). There is a lip plate assembly (52) of fabricated steel plate construction at the front of the bottom wall (14) and carrying attachment points for excavating teeth. An arch (38) of hollow, fabricated steel plate construction which spans over the front end of the basket and carries dump rope attachment points. The cheek plate structures, the lip plate assembly and the arch are connected to one another to form a ring of continuous, fabricated steel plate construction at the front end of the basket.

12 Claims, 2 Drawing Sheets

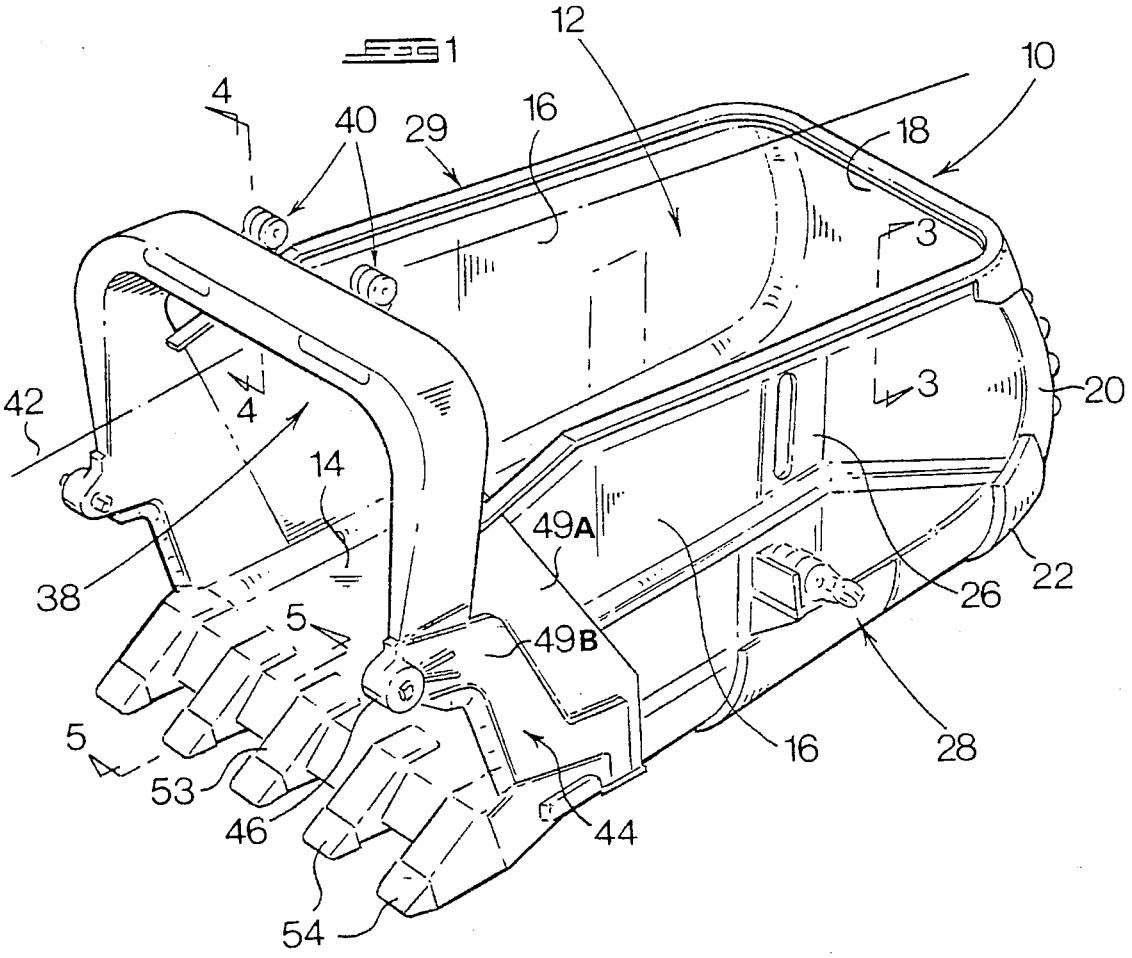
1
12
10
4
40
29
16
18
3
3
20
42
4
14
49A
22
38
26
5
49B
28
5
16
53
46
44
54
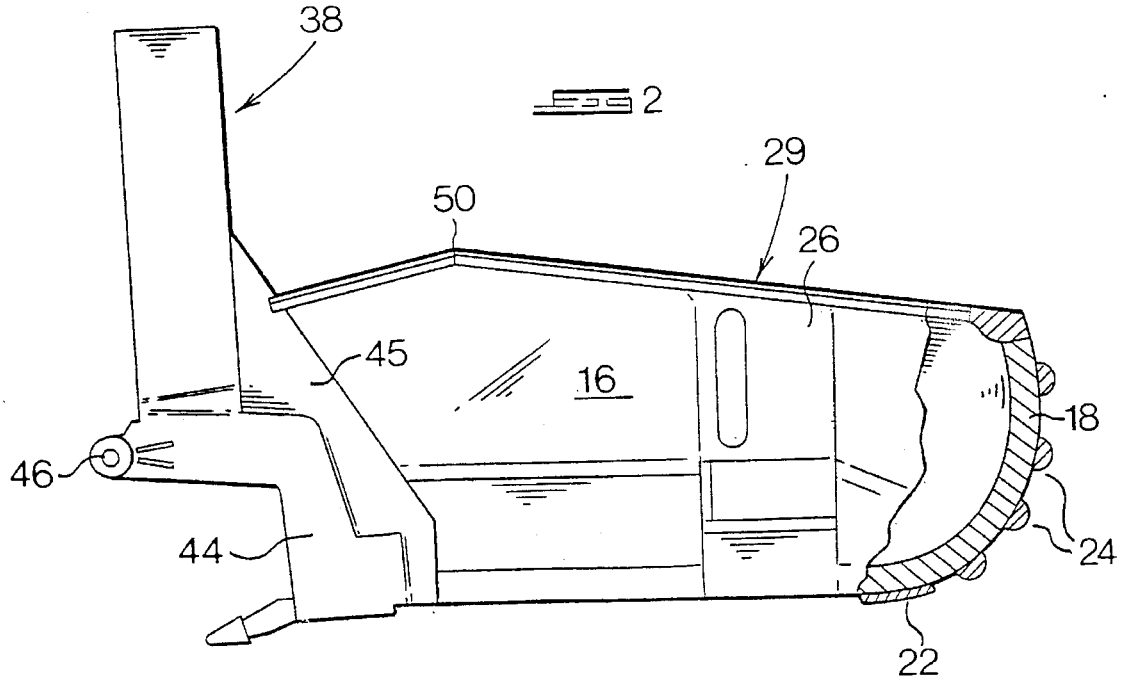
38
2
29
50
26
45
16
18
46
24
44
22

DRAGLINE BUCKET

BACKGROUND TO THE INVENTION

1. Field of the Invention

THIS invention relates to dragline buckets.

2. Discussion of the Background

The bucket of a dragline is a crucial component and to a large extent determines the efficiency with which the dragline can operate. One limitation on the efficiency of a dragline is the mass of the empty bucket. In general terms, the greater the mass of the bucket, the smaller the payload which the bucket can drag in use, because there is a limitation on the total mass which the dragline can drag.

It would accordingly be desirable to reduce the mass of the bucket without reducing the payload and without detrimentally affecting the ability of the bucket to dig into the earth or other material which is being excavated.

SUMMARY OF THE INVENTION

According to the present invention, there is provided a dragline bucket comprising a basket having an open front end and an open top defined by bottom, side and rear walls, cheek plate structures of fabricated steel plate construction which are carried by the side walls at the front end of the basket and which carry drag attachment points, a lip plate assembly of fabricated steel plate construction at the front end of the bottom wall and carrying attachment points for excavating teeth, and an arch of hollow, fabricated steel plate construction which spans over the front end of the basket and which carries dump rope attachment means, wherein the cheek plate structures, the lip plate assembly and the arch are connected to one another to form a ring of continuous, fabricated steel plate construction at the front end of the basket.

In the preferred embodiment, the arch has a hollow rectangular cross-section and is more flexible about a fore-and-aft axis of the bucket than about a vertical axis. The arch may be fabricated from high strength steel plates.

The basket is preferably fabricated from steel plates of high impact strength, abrasion resistant steel. It is typically unlined and fabricated from abrasion resistant steel plates. The side walls of the basket can have upper edges reinforced by fabricated top rail structures.

The preferred lip plate assembly has a rear portion fixed to and extending forwardly from the bottom wall of the basket and a front portion fixed to and extending forwardly from the rear portion, the rear portion being generally coplanar with the bottom wall of the basket and the front portion being inclined downwardly at an angle of approximately 8° relative to the rear portion. The front portion of the lip plate assembly may be thicker than the rear portion it may carry spaced apart noses on which excavating teeth are mountable, with adaptor structures, fabricated from steel plate, between the noses.

As used in this specification, the term "abrasion resistant steel" refers to a steel which has a Brinell hardness value of at least 400, preferably about 500 and a Charpy test value of at least 30 Joules at −40 ° C. An example of an abrasion resistant steel is HARDOX (trade mark) steel produced by SSAB of Sweden. The term "high strength steel" refers to a steel having a tensile strength of at least 700 MPa and a Charpy test value of at least 40 Joules at −40 ° C. An example of a high strength steel is WELDOX (trade mark) steel, also produced by SSAB.

BRIEF DESCRIPTION OF THE DRAWINGS

The invention will now be described in more detail, by way of example only, with reference to the accompanying drawings in which:

FIG. 1 shows a perspective view of a dragline bucket according to the invention;

FIG. 2 shows a partly sectioned side view of the bucket seen in FIG. 1;

DESCRIPTION OF A PREFERRED EMBODIMENT

Figure 3:
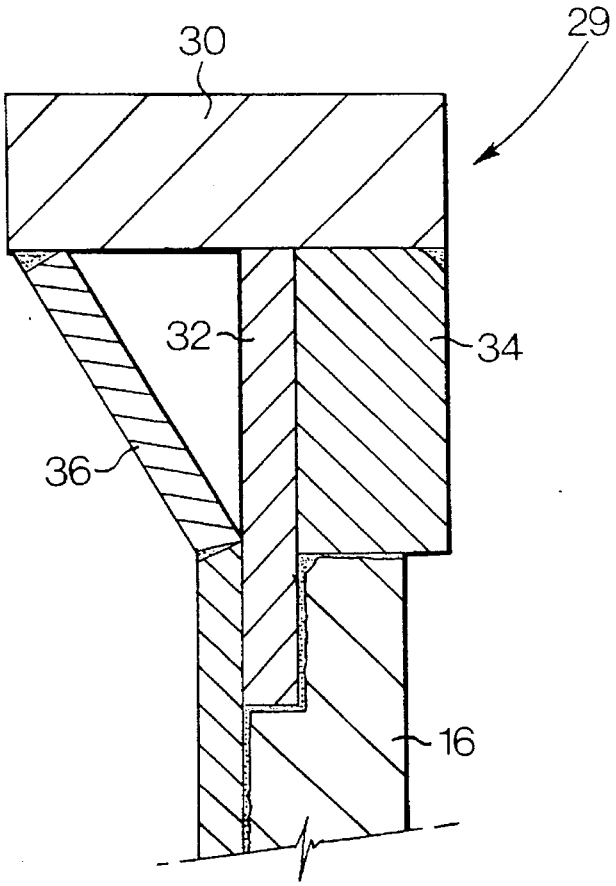
FIG. 3 shows an enlarged cross-section at the line 3—3 in FIG. 1.

FIGS. 1 and 2 illustrate a dragline bucket 10 suitable for use with a MARION 8200 or 8202 dragline. The bucket 10 has a bucket section or basket indicated generally with the reference numeral 12. As illustrated, the basket has a bottom wall 14, side walls 16 and a rear wall 18. The bottom, side and rear walls define an open front end and an open top for the basket. The basket is unlined and is largely fabricated from 16 mm thick abrasion resistant steel, typically but not necessarily HARDOX steel.

To provide added strength and resistance to abrasive wear, the comers of the basket where the side walls meet the rear wall and where the side walls meet the bottom wall are reinforced by fabricated abrasion resistant steel plate structures 20. In the region where the bottom wall 14 of the basket meets the rear wall 18, there is a sole plate structure 22 fabricated from abrasion resistant steel plates. In each case, the structures 20 and 22 are typically formed as fabricated, lobster-back structures in which a series of individual plates, each cut to a specific shape, are welded together to define the necessary curvature.

The rear wall itself is reinforced by laterally spanning ribs 24 which give the rear wall adequate strength to resist impacts imposed by, for instance, large rocks which may be picked up in use in the basket and which roll over the bottom wall and strike the rear wall.

Figure 4:
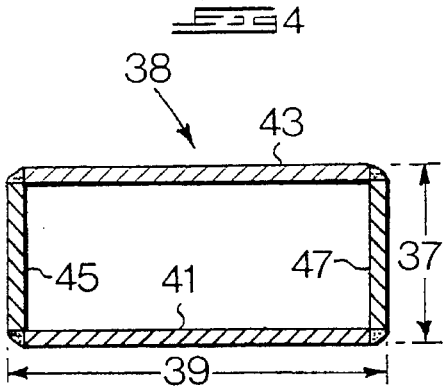
FIG. 4 shows an enlarged cross-section at the line 4—4 in FIG. 1.
Figure 6:
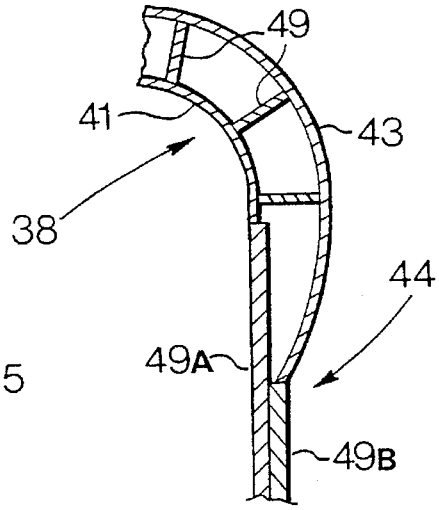
FIG. 6 shows a vertical cross-section through a cheek plate structure and illustrates the connection between the end of the arch and the cheek plate structure.

Trunnion ribs 26 are fixed to the side walls to provide extra strength in the region of the trunnions 28, to which the hoist chains of the dragline are connected in use. The upper edges of the side walls 16 are strengthened by top rail structures 29. A typical top rail structure is seen in FIG. 3. The top rail structure includes a 50 mm thick top rail plate 30 fixed across the upper edge of a 20 mm thick vertical plate 32. The vertical plate 32 is welded in a rebate in the side wall 16 and is further reinforced against bending by a 50 mm thick side plate 34 and a 16 mm thick inclined plate 36, which is formed of abrasion resistant steel. The plates 30, 32 and 34 are high strength steel plates, typically but not necessarily WELDOX steel plates. Referring to FIGS. 1 and 2, the numeral 38 indicates the arch which spans over the open front end of the basket and which supports dump rope attachment means in the form of attachment points 40. The arch 38 has a hollow rectangular cross-section as shown in FIG. 4, and is fabricated from high strength steel. The arch is fabricated from inner and outer plates 41 and 43 respectively, and front and rear plates 45 and 47. As shown in FIG. 6, spaced apart reinforcing gussets 49 span between the inner and outer plates 41 and 43.

The vertical depth 37 of the arch is considerably less than its dimension 39 from front to back. The fabricated nature of the arch, together with its reduced depth allows the arch to flex about the horizontal, fore-and-aft axis 42 of the bucket 10. The flexure of the arch is particularly important when the basket 12 carries a heavy load.

As will be apparent from FIG. 1 of the drawings, the ends of the arch 38 are connected to fabricated cheek plate structures 44 at the leading edges of the side walls 16 of the basket 12. FIG. 6 illustrates a typical arch/cheek plate connection. As seen in this FIG., the cheek plate structure 44 consists of inner and outer plates 49A and 49B arranged side by side with the inner plate 49A terminating at a higher level than the outer plate 49B. The inner plate 41 of the arch 38 is welded to the upper edge of the plate 49A and the outer plate 43 of the arch is welded to the upper edge of the plate 49B at the lower level. This construction is preferred to a construction in which the connections, which are the most likely points of weakness, are at the same level and hence subject in use to the same or similar stresses. By separating the likely stress concentrations, it is believed that a stronger overall connection is obtained.

The cheek plate structures 44 on opposite sides of the basket carry drag attachment points 46 to which the drag chains of the dragline are connected in use. The robust, fabricated cheek plate structures 44 reinforce the side walls in the region of the drag attachment points, where considerable stresses arise in use as a result of the dragging forces applied to the drag attachment points by the drag chains which drag the bucket through the material being excavated.

As shown in FIG. 1, the top rail structures 29 undergo a change of orientation at a point 50. The front ends of the top rail structures 29 are fixed to the plates 49A of the cheek plate structures 44 just behind the arch 38.

Figure 5:
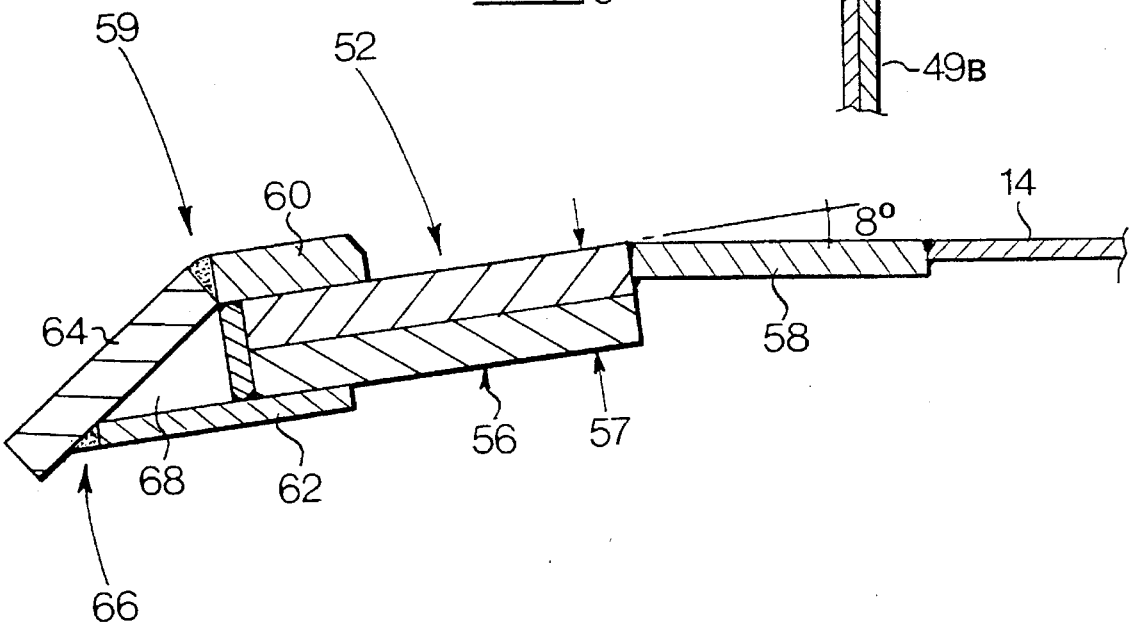
FIG. 5 shows a cross-section at the line 5—5 in FIG. 1.

FIG. 5 shows a cross-sectional detail of the lip plate assembly 52 which forms the front edge of the bottom wall 14 of the basket 12 and which extends between and is connected to the cheek plate structures on opposite sides of the bucket. The lip plate assembly 52 carries laterally spaced apart noses 53 on which replaceable excavating teeth 54 are secured in use. The lip plate assembly has a front portion 56 and a rear portion 58. In contrast to prior designs of lip plate assembly, the illustrated assembly is of fabricated rather than cast construction. The rear portion 58 in the illustrated embodiment is formed by 50 mm thick high strength steel plates, while the front portion 56 includes two back-to-back 75 mm thick high strength steel plates fixed together, giving a total thickness 57 of 150 mm.

The upper surface of the rear portion 58 of the lip plate assembly 52 is generally coplanar with the upper surface of the bottom wall 14 of the bucket section 12, and the front portion 56 is inclined downwardly at an angle of 8° relative to the rear portion.

The thicker from portion 56 in this embodiment has a dimension, extending in the fore-and-aft direction, of approximately 600 mm. This geometry is also in contrast to conventional designs, in which the cast, thicker front portion of the lip plate assembly generally only has a fore-and-aft dimension of about 325 mm and an inclination to the bottom of the bucket section of about 4°.

As mentioned previously, noses 53 are fixed to the leading edge of the front portion 56 of the lip plate assembly. Between the noses adaptor structures are fixed to the leading edge of the assembly. FIG. 5 illustrates a typical cross-section through an adaptor structure 59. As illustrated, the adaptor structure 59 is composed of upper and lower plates 60 and 62 which straddle the leading edge of the front portion 56. The plate 60 in this case has a thickness of 50 mm and the plate 62 has a thickness of 25 mm. An inclined plate 64 extends forwardly and downwardly from the plate 60 and is fixed to the lower plate 62 at a position 66. The components of the adaptor structure are of high strength steel.

In initial tests conducted with a dragline bucket of the illustrated type, it was been found that the bucket is capable of digging efficiently into the material being excavated. It is believed that this is attributable, at least in part, to the particular geometry of the lip plate assembly 52, and especially the inclination of the forward portion 56 thereof, and the geometry of the adaptor structure. Although the adaptor structure in each case comes to a relatively sharp edge, facilitating the digging action and the channelling of excavated material rearwardly into the basket between the teeth 54, no unacceptable wear of the adaptor structures was detected.

The prototype dragline bucket had a mass of 40*t* and an operational payload of about 76*t*, compared to a mass of 50*t* to 53*t* and an operational payload of about 68*t* in the case of a conventional bucket made largely of cast components. Thus, while the total mass of bucket plus payload was only slightly less for the prototype than for the conventional bucket (116*t* as opposed to 118*t* to 121*t*), there was a considerable increase in payload (76*t* as opposed to 68*t*). This in turn meant that the dragline machine operating the prototype bucket was able to perform with considerably greater efficiency, since it was able during each drag cycle to move more material without an increase in the power required. Thus for the same amount of wear and tear on the operating machine, it is expected that it will be possible to move greater amounts of material with buckets of the illustrated type.

When the empty bucket is thrown out at the commencement of each dragging cycle, a dragline machine operating with a bucket similar to the prototype will also suffer less wear and tear than a dragline machine operating with a conventional bucket, because of the reduction in the load attributable solely to the empty mass of the bucket.

It will be appreciated that the advantages just described arise from the fact that the prototype bucket is considerably lighter than the conventional buckets without any sacrifice at all in terms of payload. On the contrary, there is in fact an increase in payload. The relative lightness of the bucket is attributable to the fact that the basket is unlined and formed primarily from high impact strength, abrasion resistant steel.

During experimental operation of the prototype bucket it was also noted that the bucket structure was less prone to stress-induced fracturing at points of high stress and particularly at the connections between the arch and the side walls. In the illustrated design, the arch 38, together with the cheek plate structures 44 and lip plate assembly 52 define a continuous ring at the leading end of the bucket. This ring, being completely of fabricated construction, as opposed being at least partially of cast construction as in prior designs, enables leading end of the bucket to flex as appropriate, without fracturing, under loads imposed by the excavating action and the dead load of excavated material in the basket. For instance, the lip plate assembly 52 can bow downwardly to some extent under the dead load of excavated material in the basket, with the cheek plate structures and arch flexing as necessary to accommodate this deformation. During dragging the cheek plate structures 44, and hence the side walls 14 and arch 38, can flex as necessary under the loads imposed by the drag chains.

Despite the reduction in dead weight of the bucket, as explained above, no decrease in digging or dragging efficiency was noted in operation of the prototype bucket.

In a slightly modified arrangement, the ends of the lip plate assemblies 52 are upwardly curved where they meet and are connected to the cheek plate structures.

I claim:

1. A dragline bucket comprising:

a basket having an open front end and an open top defined by bottom, side and rear walls;

cheek plate structures carried by the side walls at a front end of the basket, the cheek plate structures being fabricated from steel plates in a laminated construction and carrying drag attachment points;

a lip plate assembly carried by the bottom wall at the front end of the basket, the lip plate assembly being fabricated from steel plates connected to each other and carrying attachment points for excavating teeth;

an arch spanning over the front end of the basket and carrying dump rope attachment means, the arch being fabricated from steel plates connected to each other to form a hollow rectangular cross-section; and the cheek plate structures, the lip plate assembly and the arch being connected to each other to form a ring of continuous, fabricated steel plate construction at the front end of the basket.

2. A dragline bucket according to claim 1, wherein at least a portion of the lip plate assembly is fabricated from steel plates fixed to one another in a laminated construction.

3. A dragline bucket according to claim 1, wherein the arch is more flexible about a fore-and-aft axis of the bucket than about a vertical axis.

4. A dragline bucket according to claim 3, wherein the arch is fabricated from high strength steel plates.

5. A dragline bucket according to claim 1, wherein the basket is fabricated from abrasion resistant steel plates.

6. A dragline bucket according to claim 5, wherein the basket is unlined and is fabricated from steel plates having a Brinell hardness value of at least 400 and a Charpy test of at least 30 Joules at –40° C.

7. A dragline bucket according to claim 6, wherein the side walls of the basket have upper edges reinforced by fabricated top rail structures.

8. A dragline bucket according to claim 1, wherein the lip plate assembly has a rear portion fixed to and extending forwardly from the bottom wall of the basket and a front portion fixed to and extending forwardly from the rear portion, the rear portion being generally coplanar with the bottom wall of the basket and the front portion being inclined downwardly at an angle of approximately 8° relative to the rear portion.

9. A dragline bucket according to claim 8, wherein the front portion of the lip plate assembly is thicker than the rear portion thereof and the front portion carried spaced apart noses on which excavating teeth are mountable.

10. A dragline bucket according to claim 9, wherein the front portion of the lip plate assembly carries adaptor structures, fabricated from steel plates, between the noses.

11. A dragline bucket according to claim 10, wherein the adaptor structures are fabricated from abrasion resistant steel plates.

12. A dragline bucket according to claim 11, wherein the front and rear portions of the lip plate assembly are fabricated from high strength steel plates.

* * * * *